US005329889A

United States Patent [19]

Caldwell

[11] Patent Number: 5,329,889

[45] Date of Patent: Jul. 19, 1994

[54] DEGAS TANK FOR ENGINE COOLING SYSTEM

[75] Inventor: Danny R. Caldwell, Flint, Mich.

[73] Assignee: Molmec, Inc., Walled Lake, Mich.

[21] Appl. No.: 155,491

[22] Filed: Nov. 22, 1993

[51] Int. Cl.[5] ..... F01P 3/22

[52] U.S. Cl. ..... 123/41.54; 165/104.32

[58] Field of Search ..... 123/41.54; 165/104.32

[56] References Cited

U.S. PATENT DOCUMENTS 4,723,596 2/1988 Spindelboeck et al. ..... 165/104.32

5,111,776 5/1992 Matsushiro et al. ..... 123/41.54

*Primary Examiner*—Noah P. Kamen

*Attorney, Agent, or Firm*—Reising, Ethington, Barnard, Perry & Milton

[57] ABSTRACT

A degas tank for the cooling system of an internal combustion engine wherein the degas tank is formed from two plastic parts each of which has a plurality of cavities formed therein that are defined by ribs and in which certain of the ribs are provided with open-ended slots so when the two parts of the degas tank are joined together, pairs of open-ended slots cooperate to form an opening through which coolant can flow between adjacent cavities.

7 Claims, 4 Drawing Sheets

DEGAS TANK FOR ENGINE COOLING SYSTEM

This invention concerns engine cooling systems, in general, and more particularly relates to a degas tank for an engine cooling system that also serves as a reservoir and expansion tank for the engine coolant.

BACKGROUND OF THE INVENTION

In certain automobiles manufactured by various auto companies, the cooling system used for the engine is of the so called "closed" type wherein a plastic degas tank is provided that is physically separated from the radiator and is closed by a pressure cap of a type normally located on the radiator. The degas tank is operated under internal pressure of about 15 PSI gage and is connected to the engine and the radiator so that the coolant circulates through the degas tank. One purpose for the degas tank is to allow entrained air and gasses in the coolant to be separated from the coolant as the coolant flows through the degas tank. In order to allow the air and gasses to escape into the degas tank, it is normal to provide the degas tank with a number of chambers or compartments which are connected in series through windows or openings formed in the ribs separating adjacent chambers so as to allow the coolant to flow between the chambers. During the injection molding process for making a degas tank of this type, the openings are formed in the ribs of the tank by using movable gate members in the molding die. When a gate member is in the closed position, the mold is filled with a liquid plastic material and, after solidification of the plastic material, the gate is moved by lifters laterally out of the opening and the die is retracted with the gate clearing the wall. As should be apparent, providing lifters within the molding die for moving the gates laterally increases the cost of the tooling for forming the degas tank. Not only does it increase the tooling cost, but increased maintenance for tooling of this sort is required.

The present invention solves the above problem by providing a two-part plastic degas tank in which the ribs separating the chambers in each part of the tank are formed with open-ended slots so as to reduce tooling cost by eliminating the multiple lifters heretofore used in the molding dies. The slots are formed in the ribs of each portion of the tank in a manner so when the two parts of the tank are joined together, the slots in opposed ribs register with each other to form an opening through which coolant can flow between the adjacent chambers.

A reservoir tank having certain similarities to the degas tank according to this invention can be seen in U.S. Pat. No. 5,111,776, issued on May 12, 1992 to Matsushiro et al. In FIG. 9 of the Matsushiro et al patent, the partitions of the tank are provided with holes and the Matsushiro specification indicates that slits or grooves in place of the holes can be provided in the walls for communication of the chambers provided in the tank. However, in Matsushiro there is neither a teaching of having a tank formed of two parts as required to practice this invention nor is there any mention of having open-ended slots located in pairs and cooperating with each other for forming an opening within a rib which serves as a partition between chambers.

In addition, Matsushiro et al fails to teach having openings between chambers which extend from the top wall to the bottom wall of a chamber or having enlarges sections formed with the ribs for increasing the bonding areas between the two parts of the degas tank. Both of the latter mentioned differences are added features of the present invention.

SUMMARY OF THE INVENTION

More specifically, the degas tank according to the present invention is formed from two separate plastic parts each having a plurality of ribs which define a plurality of cavities separated by the ribs. One of the two plastic parts serves as the upper member of the tank while the other serves as the lower member and the two members are adapted to be fixedly connected to each other to form a unitary tank having a coolant receiving chamber which can connect through additional chambers to a coolant supply chamber. In the preferred form, the upper member comprises a top wall formed with side walls which are integral with and surrounded by a peripheral rim. The upper member is also provided with a plurality of ribs which connect the side walls with the top wall and which serve as partitions for providing the cavities in the upper member. The lower member similarly includes a bottom wall formed with outer side walls which are surrounded by and formed with a peripheral rim. The rim of the lower member is of the same configuration and size as the peripheral rim of the upper member, and it surrounds the ribs of the lower member that are integrally formed with the bottom wall and serve as partitions for providing the lower member with a plurality of cavities. The bottom wall and the side walls formed therewith cooperate with the ribs of the lower member so as to provide a plurality of cavities in the lower member that are arranged in series. The series arrangement of the cavities allows the coolant to flow by gravity through the cavities successively starting with one of the cavities having a predetermined depth and each succeeding cavity having a depth greater than the preceding cavity so that the last cavity receiving the coolant serves as the coolant supply chamber. In order to allow the coolant to flow through the cavities as described above, certain ribs of both the upper member and of the lower member are formed with an open-ended slot. Thus, when the upper and lower members are joined together along their rims using a "hot plate" weld process or the like, the free edges of the ribs of the upper and lower members are fused to each other at their interfaces and the open-ended slots of the interconnecting ribs register with each other to form openings which are adapted to allow the coolant to flow through the cavities from the coolant receiving chamber to the coolant supply chamber so as to degas the coolant.

One of the objects of the present invention is to provide a new and improved degas tank for the cooling system of an internal combustion engine wherein the degas tank is formed from two plastic parts each of which has a plurality of cavities formed therein that are defined by ribs and in which certain of the ribs are provided with open-ended slots so when the two parts of the degas tank are joined together, pairs of open-ended slots cooperate to form openings through which coolant can flow between adjacent cavities.

Another object of the present invention is to provide a new and improved degas tank for the cooling system of an internal combustion engine that is provided with a plurality of chambers for allowing coolant to flow successively through the chambers starting at a coolant receiving chamber and ending at a coolant supply chamber and in which the partition dividing a pair of adjacent chambers through which the coolant flows is formed by a pair of opposed ribs each of which has an open-ended slot formed therein for forming the opening between the adjacent chambers.

Yet another object of the present invention is to provide a new and improved degas tank for the cooling system of an internal combustion engine in which the degas tank is molded in two parts from a plastic material and in which the degas tank is provided with a plurality of interconnecting chambers separated from each other by ribs some of which are provide with an opening for coolant flow between adjacent chambers and in which the complete opening is not entirely formed until the two parts of the degas tank are joined together to form a unitary member.

A further object of the present invention is to provide a new and improved degas tank for a closed type cooling system of an internal combustion engine in which the degas tank is molded in two parts from a plastic material and wherein a plurality of chambers are provided within the tank that are separated from each other by ribs formed with enlarged sections so, when the two parts are joined together using a hot plate weld process, the enlarged sections provide an enlarged bonding area which serves to help withstand the internal pressure tending to separate the two parts of the tank.

A still further object of the present invention is to provide a new and improved degas tank for the cooling system of an internal combustion engine in which the degas tank is molded in two parts from a plastic material and in which the degas tank is provided with a plurality of chambers, pairs of which communicate with each other for coolant flow therebetween through openings which extend from the top wall to the bottom wall of the chamber so as to provide increased area for coolant flow between adjacent chambers.

BRIEF DESCRIPTION OF THE DRAWINGS

Other objects and advantages of the present invention will be more apparent from the following detailed description when taken with the drawings in which.

DETAILED DESCRIPTION OF THE PREFERRED EMBODIMENT

Figure 1:
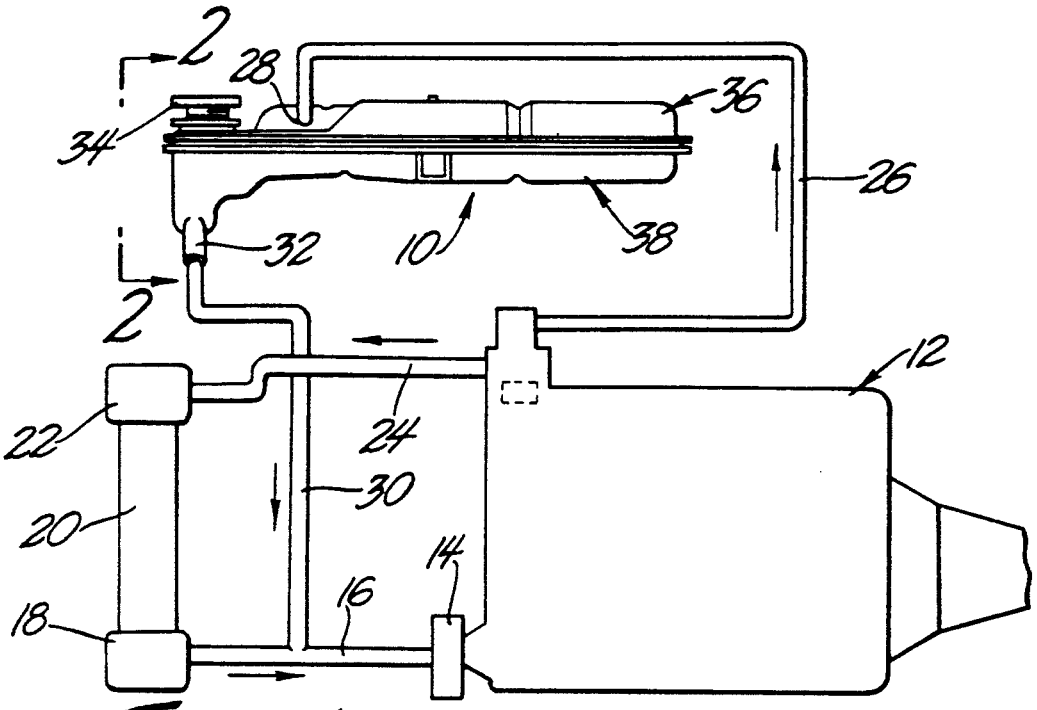
FIG. 1 is a diagrammatic view of an engine cooling system incorporating a degas tank made in accordance with the present invention.

Referring now to the drawings and more particularly FIG. 1 thereof, a degas tank 10 according to the present invention is shown employed with the cooling system of an internal combustion engine 12 having the usual water pump 14 connected by a hose 16 to the lower header 18 of a radiator 20. The upper header 22 of the radiator is shown connected by a hose 24 to the upper part of the engine jackets which, in turn, is connected via a hose 26 to an inlet tube 28 which forms a part of the degas tank 10. In addition, a hose 30 is connected at one end to the hose 16 intermediate the lower header 18 and the water pump 14. The other end of the hose 30 is connected to an outlet tube 32 which forms a part of the degas tank 10. A conventional removable pressure cap 34 is threaded on the degas tank 10 and is provided with a relief valve (not shown) designed so as to match the permissible pressure of the radiator 20 and serves to relieve pressure and gases when the pressure within the radiator 20 and the cooling system exceeds a predetermined value.

As should be apparent to those skilled in the art, the cooling system shown in FIG. 1 is a so called "closed" system. As is well known, in this type of cooling system, the degas tank 10 fulfills several important chores. First, it serves to compensate for volume changes resulting from the temperature changes of the coolant. Second, it collects the air present in the cooling system and, third, it prevents cavitation in front of the water pump 14. In order to achieve these functions, the degas tank 10 is installed in parallel with the main coolant circuit of the engine cooling system and the highest point of the main coolant circuit is connected to the inlet tube 28 of the degas tank 10 while the outlet tube 32 of the degas tank 10 is connected ahead of the water pump in the manner as seen in FIG. 1. Coolant flow is indicated by the arrows adjacent each of the hoses.

Figure 2:
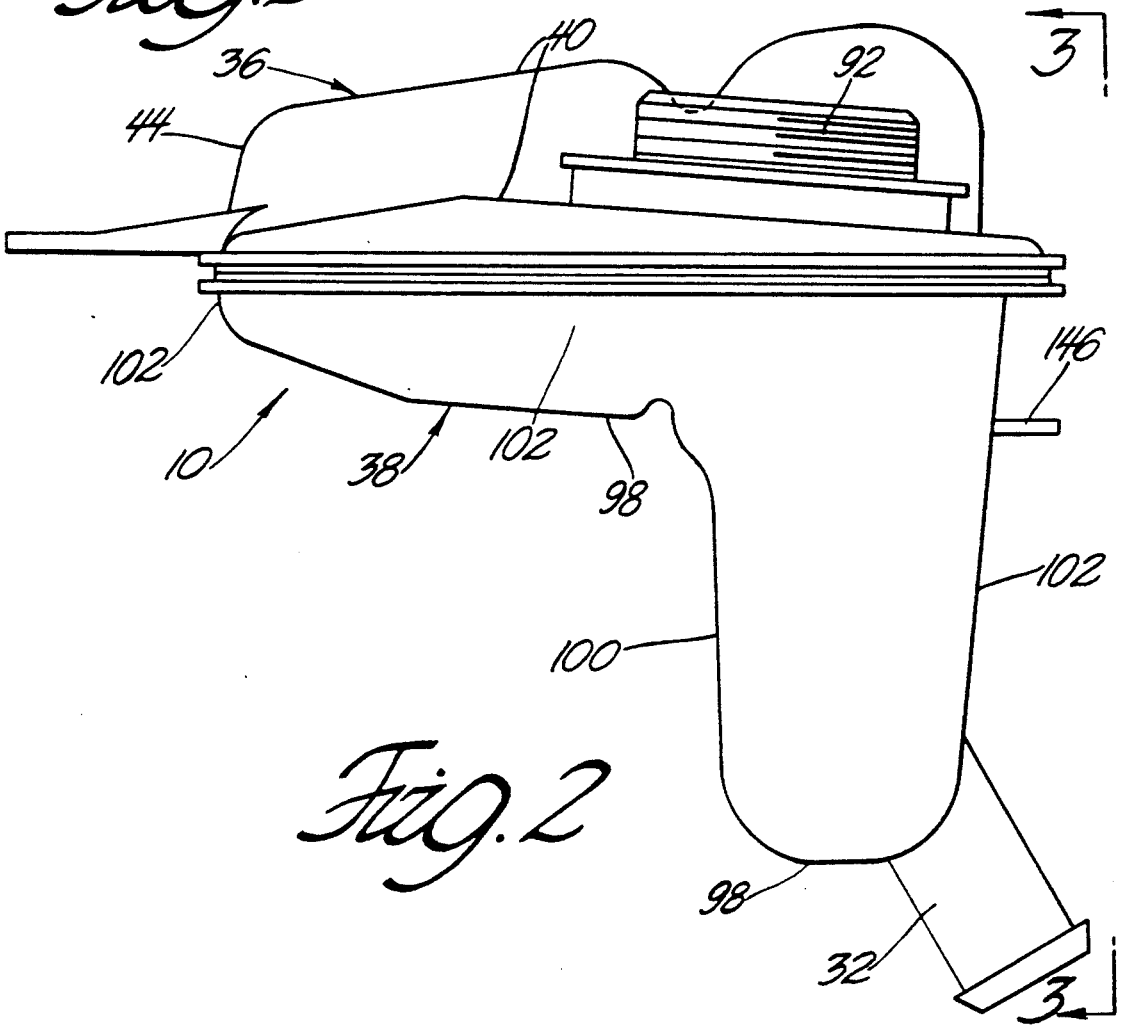
FIG. 2 is an enlarged end view of the degas tank taken on line 2—2 of FIG. 1 and shows the degas tank with the pressure cap removed and disconnected from the coolant hoses.
Figure 3:
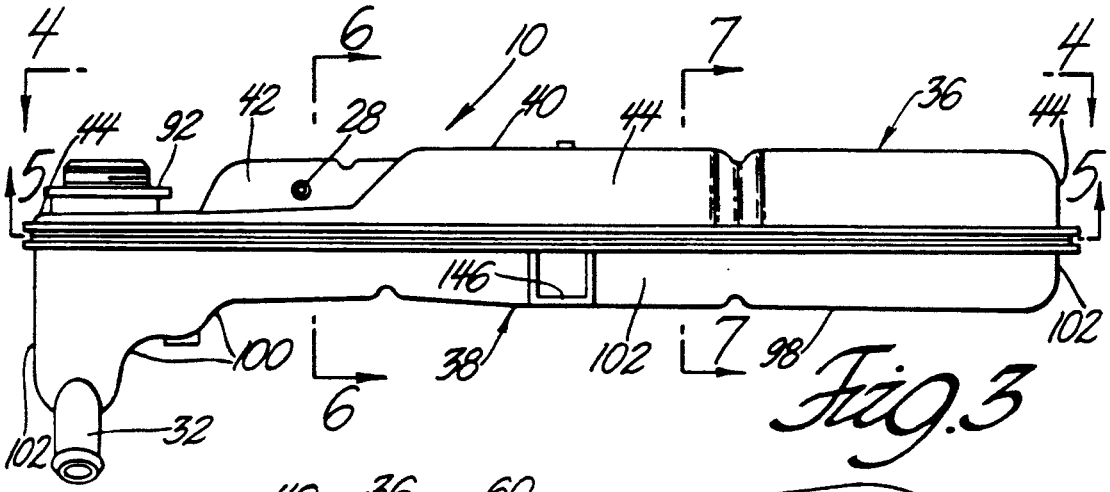
FIG. 3 is a reduced in size side elevation view of the degas tank taken on line 3—3 of FIG. 2.

As seen in FIGS. 2 and 3, the degas tank 10 is shown disconnected from the hoses 26 and 30 of the cooling system of FIG. 1 and, in addition, has the pressure cap 34 removed therefrom so as to more clearly illustrate the construction of the degas tank 10. In this regard, it will be noted that the degas tank 10 is a unitary structure composed of an upper member 36 and a lower member 38 which are adapted to be fixedly connected together in a manner to be described hereinafter. In addition, both the upper member 36 and the lower member 38 of the degas tank 10 are made from a plastic material such as polypropylene or other suitable plastic material capable of withstanding the high underhood temperatures of an engine compartment.

Figure 4:
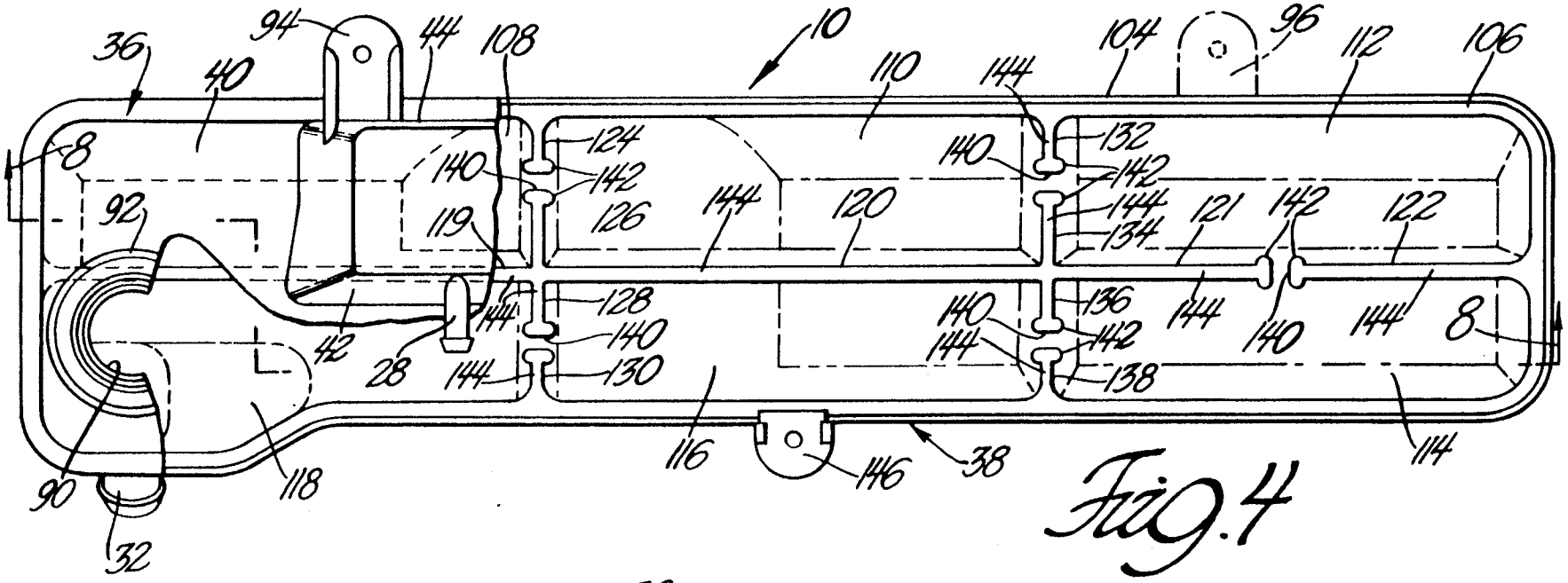
FIG. 4 is an enlarged plan view of the degas tank taken on line 4—4 of FIG. 3 with parts of the upper member of the degas tank broken away so as to show the details of construction of the lower member of the degas tank.
Figure 5:
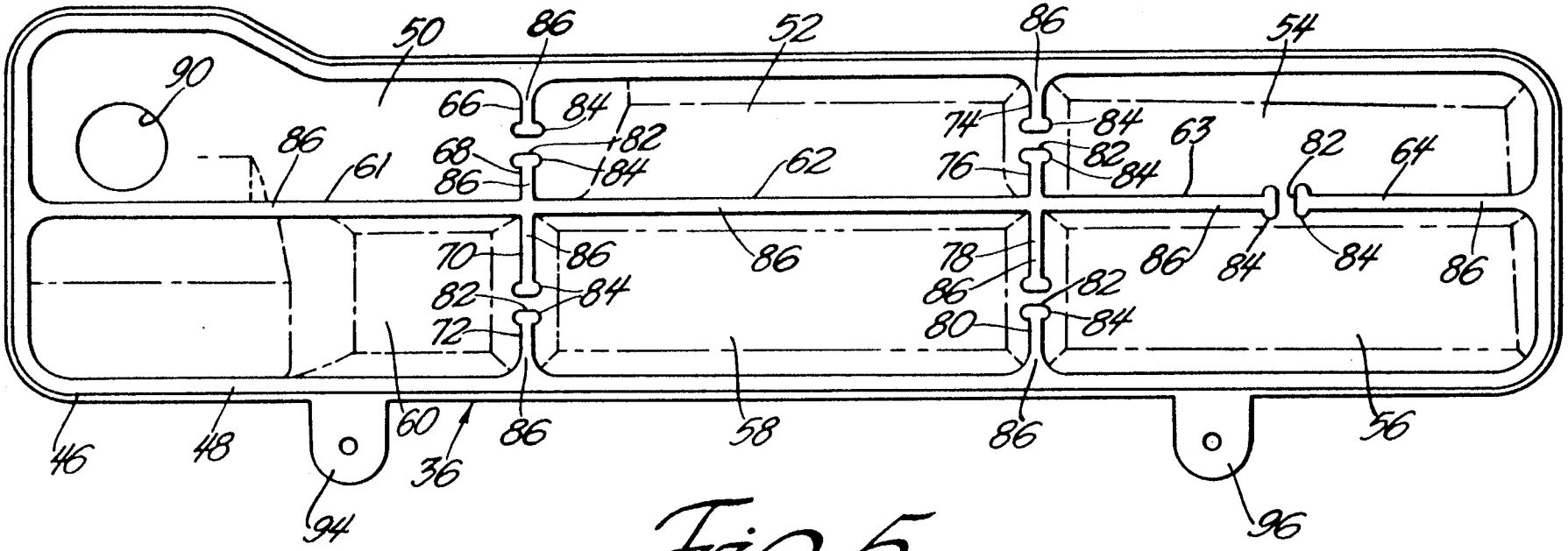
FIG. 5 is an enlarged plan view of the upper member of the degas tank taken on line 5—5 of FIG. 3.

More specifically, as seen in FIGS. 3–5, the upper member 36 is generally rectangular when viewed from above and includes a stepped top wall 40 integrally formed with inner side walls 42 and outer sidewalls 44 the latter of which are integral with a peripheral rim 46 having a seating surface 48 lying in a single horizontal plane. As best seen in FIGS. 5–8, the top wall 40 and the side walls 42 and 44 of the upper member 36 are designed so as to provide a plurality of cavities 50–60 within the upper member 36. The individual cavities 50–60 are defined by longitudinally extending and aligned rib members 61–64, transversely extending and aligned rib members 66–72, and transversely extending and aligned rib members 74–80. Each of the rib members 61, 64, 66, 72, 74 and 80 is integral with the top wall 40 and the side wall to which it is attached. On the other hand, the rib members 62, 63, 68, 70, 76 and 78 are integrally formed with the top wall 40 and the rib member 61.

Figure 6:
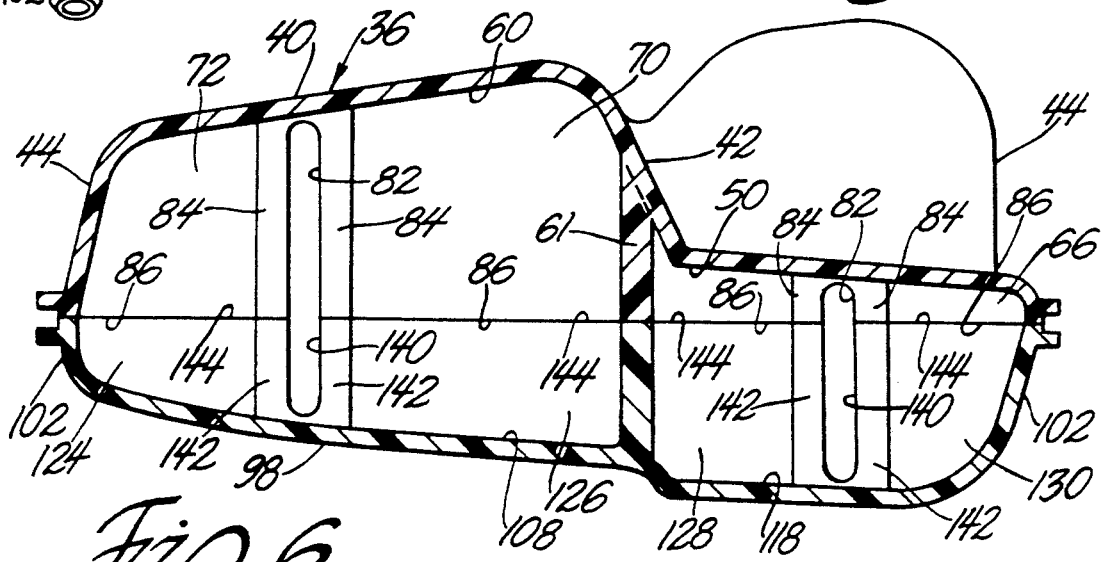
FIG. 6 is an enlarged sectional view of the degas tank taken on line 6—6 of FIG. 3.
Figure 7:
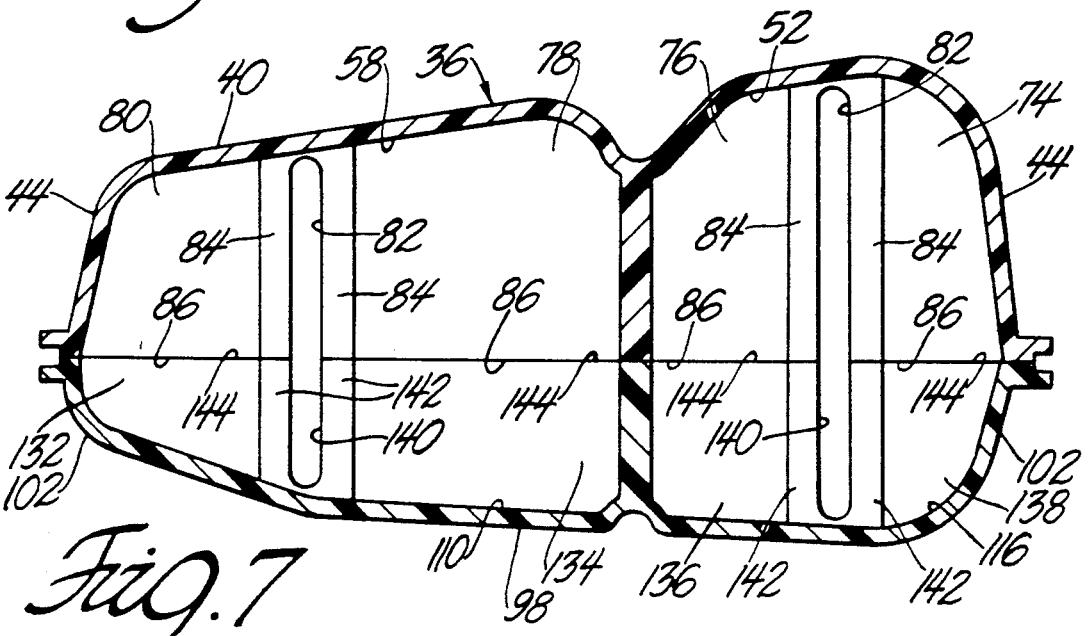
FIG. 7 is an enlarged sectional view of the degas tank taken on line 7—7 of FIG. 3.

As seen in FIGS. 5, 6 and 7, each pair of axially aligned ribs 63 and 64, 66, and 68, 70 and 72, 74 and 76, 78 and 80, cooperate to provide an open-ended U-shaped slot 82 which serves as an opening for allowing communication between adjacent cavities. In each case, the slot 82 is defined by an enlarged section 84 formed at the free end of each of the associated pair of rib members. The enlarged section 84 in each case is uniform in cross section and, as seen in FIGS. 6 and 7, extends the full vertical length of the associated rib member. In addition, it will be noted that each of the rib members 61–80 terminates with a planar seating surface 86 which lies in the plane of the seating surface 48 of the rim 46.

The inlet tube 28 is connected to the side wall 42 of the upper member 36 and is provided with a through-passage 88 which connects with the cavity 60. Also, the top wall 40 of the upper member 36 is formed with a circular filler opening 90 surrounded by a cylindrical boss 92 integral with the top wall 40 and formed with threads for accommodating the pressure cap 34. In addition, the upper member 36 has a pair of mounting flanges 94 and 96 formed therewith that extend laterally outwardly from the body of the upper member 36.

As seen in FIGS. 2–4, the lower member 38 of the degas tank 10 is formed with a stepped bottom wall 98 integrally formed with inner sidewalls 100 and outer sidewalls 102 the latter of which are integral with a peripheral rim having a seating surface 106 lying in a single plane. As in the case of the upper member 36, the bottom wall 98 and the side walls 100 and 102 of the lower member 38 are shaped so as to provide a plurality of cavities 108–118 in the lower member 38. Also, as in the case of the upper member 36, the cavities 108–118 are defined by rib members formed with the body of the lower member 38 which, in this instance, consist of longitudinally extending and axially aligned rib members 119–122, transversely extending and axially aligned rib members 124–130, and transversely extending and axially aligned rib members 132–138. Here again, as with the upper member 36, each of the rib members 119, 122, 124, 130, 132 and 138 is integral with the bottom wall 98 and the side wall 102 from which it extends and the rib members 120, 121, 126, 128, 134 and 136 are integrally formed with the bottom wall 98 and the rib member 119.

Referring to FIGS. 4, 6 and 7, each pair of aligned rib members 121 and 122, 124 and 126, 128 and 130, 132 and 134, 136 and 138, cooperate to provide an open-ended U-shaped slot 140 which permits communication between adjacent cavities of the lower member 38. As with the rib members of the upper member 36, the slot 140 is defined by an enlarged section 142 formed at the free end of each the associated pair of rib members defining the slot 140. The enlarged section 142 is uniform in cross section and extends the full vertical length of the associated rib member. Also, each of the rib members 119–138 terminate with a planar seating surface 144 which lies in the plane of the seating surface 106 of the rim 104, the latter of which is of the same configuration and size as the rim 46 of the upper member 36.

It will be noted that the lowest point of the bottom wall 98 is formed with the outlet tube 32 having a passage which connects with the cavity 118 of the lower member 38. Also, the body of the lower member 38 has a mounting flange 146 formed therewith which is located on the opposite side of the two mounting flanges 94 and 96 of the upper member 36. As should be apparent, the three mounting flanges 94, 96 and 146 allow the degas tank 10 to be secured to a structural part of a vehicle, an important consideration being that, as seen in FIG. 1, the degas tank 10 is positioned in the engine compartment with the plane of the joined seating surfaces 48 and 106 of the rims being located in a horizontal plane. By so doing, the cavities 108–118 of the lower member 38 will be properly positioned to permit the coolant to flow from one cavity to the next as described above.

Figure 8:
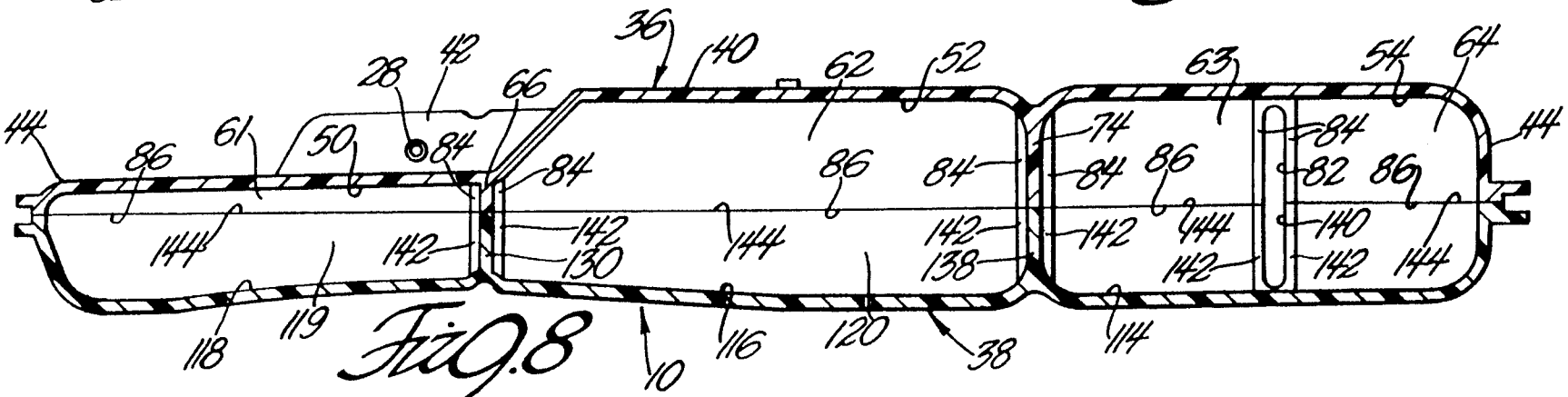
FIG. 8 is a sectional view of the degas tank taken on line 8—8 of FIG. 4.

In view of the above description, it should be apparent that after the upper member 36 and lower member 38 are formed using an injection molding apparatus, the upper member 36 is placed on the lower member 38 with the seating surfaces 48 of rim 46 in contact with the seating surfaces 106 of rim 104 as seen in FIGS. 2–4 and 6–7. When the upper member 36 and lower member 38 are combined in this manner, the seating surfaces 86 of the longitudinally extending rib members 61–64 of the upper member 36 will contact the seating surfaces 144 of the longitudinally extending rib members 119–122 of the lower member 38. At the same time the rib members 66–72 of the upper member 36 will contact the corresponding rib members 124–130 of the lower member 38 and the rib members 74–80 of the upper member 36 will contact the corresponding rib members 132–138 of the lower member 38 so that the open-ended slots 82 and 140 of the upper and lower members 36 and 38, respectively, serve to form completely enclosed openings which extend vertically from the top wall 40 to the bottom wall 98 as seen in FIGS. 6–8. By having each of such openings extend from the top wall 40 to the bottom wall 98, increased coolant flow between cavities is realized which could be important when the degas tank is utilized with high performance engines.

The permanent joining of the upper and lower members 36 and 38 is performed using a "hot plate" process which causes the plastic material at all of the contacting seating surfaces between the rib members and the rims to be melted and fused together. Moreover when the upper and lower members 36 and 38 are joined together in this manner, the opposed cavities cooperate to form chambers within the degas tank 10. In addition, by having the rib members formed with the enlarged sections 84 and 142 as described above, an increased bonding area is provided which strengthens the joint between the upper member 36 and the lower member 38 so as to prevent separation of the two members 36 and 38 when the degas tank 10 is pressurized.

When the degas tank 10 described above is employed with an engine cooling system as seen in FIG. 1 and the degas tank 10 is positioned within the engine compartment so that the seating surfaces 46 and 104 are located in a horizontal plane as mentioned above, the portion of the bottom wall 98 forming the cavity 108 will be at the highest point while the portion of the bottom wall 98 forming the cavity 118 will be at the lowest point while of the degas tank. Also, as alluded to above, the bottom wall 98 of the cavities 110, 112, 114 and 116 are configured so that they are successively lower in that order resulting in the coolant received by the cavity 108 via the hose 26 connected to the inlet tube 28 flowing through the several openings formed by the slots 82 and 140 and through the cavities 110, 112, 114 and 116, in that order until the coolant is finally settled in the cavity 118 which is connected by the outlet tube 32 to the hose 30 which, in turn is connected with the hose 16 leading to the inlet of the water pump 14. Thus, as the coolant flows through the several cavities of the degas tank 10, air and gases entrained in the coolant will collect in the upper portions of the cavities 50–60 of the upper member 36 and, when the pressure exceeds the preset pressure of the relief valve in the pressure cap 34, the air and gases will be vented to atmosphere.

Finally, although the rib members defining the slots 82 and 140 of the upper member 36 and the lower member 38, respectively, are identified by separate reference numerals and are referred to as separate rib members, such pairs of rib members can actually be considered a single rib member formed with a slot and a pair of enlarged sections. Also, even though the degas tank 10 is illustrated as having six chambers, it should be apparent that less than this number of chambers can be provided and still have the degas tank 10 perform in accordance with the invention.

Various changes and modifications can be made in the above-described degas tank without departing from the spirit of the invention. Such changes and modifications are contemplated by the inventor and he does not wish to be limited except by the scope of the appended claims.

The embodiments of the invention in which an exclusive property or privilege is claimed are defined as follows:

1. A degas tank for use with the cooling system of an internal combustion engine and adapted to have a pressure cap mounted thereon, said degas tank comprising an upper member and a lower member both made of a plastic material and adapted to be fixedly connected to each other to form a unitary tank, the upper member being formed with a first peripheral rim, first rib means integrally formed in said upper member, said first rib means being surrounded by said first peripheral rim and serving as partitions for providing the upper member with a plurality of first cavities, the lower member being formed with a second peripheral rim having the same configuration and size as the first peripheral rim of the upper member, said lower member having second rib means integrally formed therewith for providing the lower member with a plurality of second cavities which correspond in shape and size at their open ends with the shape and size of the open ends of the first cavities, said first rib means and said first peripheral rim of said upper member each having first seating surfaces lying is a first plane, said second rib means and said second peripheral rim each having second seating surfaces lying in a second plane so when said upper member is joined to said lower member at said first and second seating surfaces, said first and second cavities cooperate to form a plurality of chambers, and slot means formed in the first and second rib means for providing openings which serve to connect said plurality of chambers in series starting with a liquid coolant receiving chamber and ending with a liquid coolant supply chamber so as to allow the gases entrained in the coolant to collect in the degas tank and be exhausted to atmosphere through the pressure cap.

2. A degas tank for use with the cooling system of an internal combustion engine, comprising an upper member and a lower member both made of a plastic material and adapted to be fixedly connected to each other to form a unitary tank, the upper member having a top wall formed with a first peripheral rim lying in a first plane which is lower than any portion of said top wall, first rib means integrally formed with said top wall and serving as partitions for providing the upper member with a plurality of first cavities, the lower member having a bottom wall formed with a second peripheral rim having the same configuration and size as the first peripheral rim and lying in a second plane which is higher than any portion of said bottom wall, second rib means integrally formed with said bottom wall and serving as partitions for providing the lower member with a plurality of second cavities, said bottom wall cooperating with said second rib means so as to have said second cavities arranged to allow coolant flow in series starting with one of said second cavities serving as a liquid-coolant receiving cavity having a predetermined depth and each succeeding cavity of said second cavities having a depth greater than the preceding cavity whereby the last of the second cavities serves as a liquid-coolant supply cavity, and said first rib means and said second rib means each being formed with an open-ended slot, the arrangement of said slot of said first and second rib means being such that when the first peripheral rim is joined to the second peripheral rim, the first rib means and the second rib means contact each other and the open-ended slot of the first rib means and the open-ended slot of the second rim means register together at their open ends to form openings which are adapted to allow liquid coolant to flow successively from said one of said second cavities to said last of the second cavities so as to degas the liquid coolant.

3. The degas tank of claim 2 wherein said first and second rib means are provided with enlarged sections for increasing the bonding area between said upper and lower members.

4. The degas tank of claim 3 wherein said enlarges sections are located on opposed sides of said slot.

5. The degas tank of claim 4 wherein each of said enlarged sections are T-shaped when viewed in cross section.

6. The degas tank of claim 2 wherein each of said openings formed by said slots extends vertically from said top wall to said bottom wall.

7. A degas tank for use with the cooling system of an internal combustion engine, said degas tank including an upper member and a lower member both made of a plastic material and adapted to be fixedly connected to each other to form a unitary tank having a coolant receiving chamber and a coolant supply chamber;

said upper member having a top wall and first side walls formed with a first peripheral rim;

first rib means integrally formed with said top wall and serving as partitions for providing the upper member with a plurality of first cavities;

said lower member including a bottom wall and second side walls formed with a second peripheral rim having substantially the same configuration and size as the first peripheral rim of the upper member;

second rib means integrally formed with said bottom wall and said second side walls and serving as partitions for providing the lower member with a plurality of second cavities, said bottom wall cooperating with said second rib means so as to have said second cavities arranged to allow coolant flow in series starting with one of said second cavities serving as the coolant receiving chamber having a predetermined depth and each succeeding cavity of said second cavities having a depth greater than the preceding cavity whereby the last cavity in the series of second cavities serves as the coolant supply chamber;

and said first rib means and said second rib means being formed with open-ended slot means so when the first peripheral rim of the upper member is joined to the second peripheral rim of the lower member, the first rib means and the second rib means contact each other and the open-ended slot means of the first rib means and the open-ended slot means of the second rim means register together at their open ends to form vertically extending oblong openings which are adapted to allow coolant to flow successively through said second cavities from said coolant receiving chamber to said coolant supply chamber so as to degas the coolant.

* * * * *